United States Patent [19]

Riemscheid et al.

[11] Patent Number: 5,054,756

[45] Date of Patent: Oct. 8, 1991

[54] DEVICE FOR HYDRAULIC EXPANSION

[75] Inventors: Helmut Riemscheid; Herbert Frielingsdorf, both of Lohmar; Heribert Grewe, Overath; Karl Weiss, St. Augustin; Rudolf Schulze, Much; Engelbert Schwarz, Ruppichteroth; Helmut Swars, Bergisch Gladbach; Arnold Palussek, Engelskirchen, all of Fed. Rep. of Germany

[73] Assignee: Emitec Gesellschaft für Emissionstechnologie mbH, Lohmar, Fed. Rep. of Germany

[21] Appl. No.: 639,315

[22] Filed: Jan. 8, 1991

Related U.S. Application Data

[63] Continuation of Ser. No. 305,865, filed as PCT DE88/00301 on May 20, 1988, published as WO88/09233 on Dec. 1, 1988, abandoned.

[30] Foreign Application Priority Data

May 21, 1987 [DE] Fed. Rep. of Germany ..... 3716986

[51] Int. Cl.[5] ..... B23B 31/40

[52] U.S. Cl. ..... 269/48.1

[58] Field of Search ..... 269/22, 48.1, 48.3; 242/72 R, 72 B; 279/2 A, 4; 294/93, 98.1; 82/44

[56] References Cited

U.S. PATENT DOCUMENTS

| | | | |
|---|---|---|---|
| 3,310,972 | 3/1967 | Erlandson et al. . | |
| 3,388,916 | 6/1968 | Winnen et al. | 269/48.1 |
| 4,253,694 | 3/1981 | Walter et al. | 279/2 A |
| 4,317,577 | 3/1982 | Cameron | 279/2 A |
| 4,368,571 | 1/1983 | Cooper . | |
| 4,368,996 | 1/1983 | Davis et al. | 269/48.1 |
| 4,616,392 | 10/1986 | Snyder | 269/48.1 |
| 4,624,184 | 11/1986 | Katz et al. | 269/48.1 |
| 4,840,323 | 6/1989 | Nakajima | 279/2 A |

FOREIGN PATENT DOCUMENTS

| | | | |
|---|---|---|---|
| 1152876 | 8/1983 | Canada . | |
| 177045 | 4/1986 | European Pat. Off. . | |
| 213529 | 3/1987 | European Pat. Off. . | |
| 923964 | 7/1954 | Fed. Rep. of Germany . | |
| 1131486 | 6/1962 | Fed. Rep. of Germany | 279/2 A |
| 1939105 | 2/1970 | Fed. Rep. of Germany . | |
| 3203144 | 8/1983 | Fed. Rep. of Germany . | |
| 3312073 | 10/1984 | Fed. Rep. of Germany . | |
| 3530600 | 3/1987 | Fed. Rep. of Germany . | |
| 2531883 | 2/1984 | France . | |
| WO/87457 | 1/1987 | PCT Int'l Appl. . | |
| 853630 | 11/1960 | United Kingdom . | |

*Primary Examiner*—Robert C. Watson

*Attorney, Agent, or Firm*—Toren, McGeady & Associates

[57] ABSTRACT

Devices are described which are suitable for simultaneous hydraulic expansion of several longitudinal sections of a hollow shaft for the production of connections by interlocking or frictional engagement between said sections and elements fitted thereto such as cams, toothed wheels and bearing seats. The devices include pressure probes with a longitudinal hydraulic fluid channel and a radial inlet bore to each longitudinal section of the hollow shaft to be expanded and, if necessary, with a longitudinal discharge channel and a radial discharge bore to the undeformed longitudinal sections of the hollow shaft between the sections to be expanded. Sealing means are provided which seal the undeformed longitudinal sections of the hollow shaft against penetration of the hydraulic fluid from the intermediate longitudinal sections of the hollow shaft to be expanded. It is possible to fit individual sealing elements and/or expansion sleeves with intermediate spacer sleeves onto the body of a probe of uniform cross-section to permit rapid exchange of worn seals. In addition, the probe body can consist of sections screwed together axially which, when of small cross-section, accept sealing elements and, when of larger cross-section serve as spacer pieces. Examples of novel and improved seal shapes are also given.

26 Claims, 9 Drawing Sheets

DEVICE FOR HYDRAULIC EXPANSION

Figure 1:
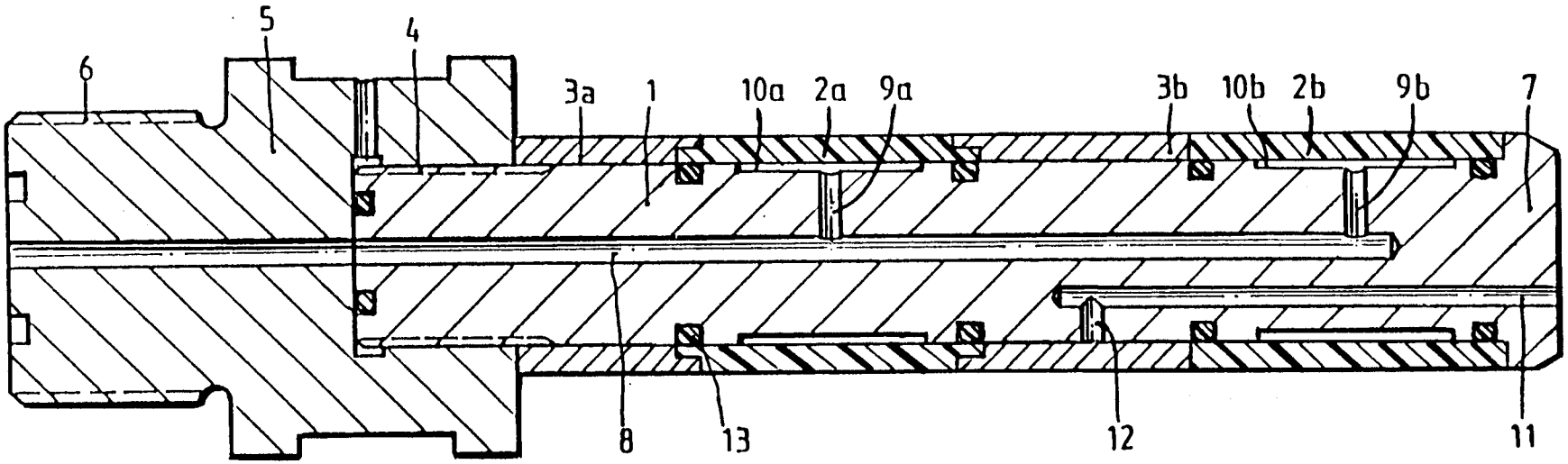

This is a continuation application of Ser. No. 07/305,865, filed Mar. 17, 1989, now abandoned, which is in the U.S. Phase of PCT/DE88/00301, filed May 20, 1988 published as WO88/09233 on Dec. 1, 1988, now abandoned.

The invention is directed to a device for the simultaneous hydraulic expansion of a plurality of longitudinal portions of a hollow shaft for the production of force-locking and/or positive-locking connections between the latter and elements slid thereon, such as cams, toothed wheels or bearing seats. The device has the form of a pressure medium probe comprising a longitudinally extending feed channel and radial feed bore holes to every longitudinal portion of the hollow shaft to be expanded and possibly comprising a longitudinally extending discharge channel and radial discharge bore holes to the portions of the hollow shaft remaining undeformed between the respective longitudinal portions of the hollow shaft which are to be expanded. Sealing means are provided at the probe which seal the longitudinal portions of the hollow shaft remaining undeformed relative to the action of the pressure medium from the longitudinal portions of the hollow shaft to be expanded which lie between them.

Devices, according to the aforementioned principle, comprising a single longitudinal portion defined by a sealing arrangement, which longitudinal portion can be sealed relative to the pipe interiors and can be acted upon by pressure medium, are known in the field of hydraulic expansion of pipes which are to be fastened in pipe bases of steam generators. Such devices are not suitable for the aforementioned area of use due to the complicated positioning when there is a plurality of expansion portions located one after the other and because of the process connected with this which, in its entirety, is long.

The principle of a device with a plurality of longitudinal portions which are sealable relative to the pipe interiors is prescribed in connection with the aforementioned object, wherein simple O-rings inserted in grooves are used as sealing elements, which O-rings are not suitable in this form for the aforementioned area of use (P 35 30 600.9).

In the construction of a device with a plurality of expansion portions for the aforementioned area of use, the special range of problems consists in that devices must be made available for series production whose seals withstand the occurring hydraulic pressures in the order of magnitude of several thousand bar at least for the duration of a shift, i.e. for several hundred to several thousand expansion processes, and which are suitable under the aforementioned conditions for bridging and sealing a reliable seal at every expansion point, also when the interior of the hollow shaft is uneven and, in particular, not perfectly axial. Preferably, an easy exchange and replacement of the worn sealing elements of the device should be possible after the service life has expired. The object of the present invention is to provide such a probe.

In order to meet this object, devices with expansion arrangements are indicated, according to the independent patent claims, which possess sealing means, which are improved in a novel manner and have a longer service life, and which in part allow seals which are continuous along the circumference and have suitable shapes and accordingly an improved action and simultaneously facilitate the exchange of worn sealing elements.

According to the suggested process, a pressure medium is fed to every expansion arrangement via the longitudinally extending feed channels and via the individual radial feed bore holes, so that all expansion areas of the hollow shaft are acted upon by pressure and deformed in a plastic manner simultaneously. The leakage water which, depending on the constructional type of sealing means, reaches into the intermediate areas between the expansion areas outside the probe into the hollow shaft is to be guided out via radial discharge bore holes located in these areas and via a shared longitudinally extending discharge channel, so that no pressure buildup or unwanted deformation of the hollow shaft occurs in these areas.

A solution, according to the invention, consists in that the probe comprises a probe base body of uniform diameter, which receives the pressure medium feed and discharge channels, and comprises expansion arrangements, which are slid on the latter and communicate with the feed bore holes, and spacer bushes which lie between the latter and preferably embrace portions of the discharge bore holes. The solution indicated here enables the use of sealing rings which are closed along the circumference and have a substantially greater material strength and greater resistance to wear than standard elastic O-rings, particularly seals of hard plastics materials which can already contact the pipe interiors so as to be relatively tight prior to the application of hydraulic force and which can favorably overcome deviations in the coaxiality of the pipe interiors because of a radial play which is as great as possible.

The modular construction of the device enables an easy exchange of worn seals, wherein, in a preferred manner, the probe base body of substantially uniform cross section comprises a thickened probe head as axial stop and has a thread at its opposite end with which the probe body can be screwed to a coupling piece for communicating with a pressure generation system—possibly accompanied by slight axial pretensioning of the expansion arrangements and the spacer bushes.

According to a first novel construction of the present invention, the expansion arrangement comprises a one-piece expansion bush which covers the entire expansion area, can be acted upon from the inside by pressure medium over substantial portions of its length and is radially expandable in its entirety, wherein for the purpose of hydraulic expansion of the hollow shaft, its surface contacts the inner surface of the latter. The advantage of such a construction of the expansion areas consists in an improved possibility for sealing, wherein the required radial distance can be bridged easily with a suitable selection of work material for the expansion sleeves. The sealing areas are not formed at the relatively uneven inner surface of the hollow shaft, so that for this reason alone harder materials can be used. The sealing can be effected at the outer edge areas relative to the probe body and/or at the end faces, according to the labyrinth type seals, relative to the abutting spacer sleeves. In this way, the leakage water can also be guided out without reaching the inner wall of the hollow shaft. The intermediate bushes preferably consist of metal. An annular space of small radial thickness located within the expansion bushes can be formed as an internal chamber in the sleeve or as a recess on the probe base body. In this case, other recesses can also be provided in the probe base body as receptacles for additional sealing elements without diverging from the basic idea of the invention.

According to a further modification which allows for the use of elastic material the expansion sleeves comprise a cylindrical jacket having a large wall thickness and annular flanks which have a smaller wall thickness and are supported on the outside by the spacer sleeves. The large wall thickness at the circumference prevents the material under high pressure from flowing into the gaps toward the spacer sleeves, whereas the portions which have a smaller wall thickness are supported at the flanks along their entire height and thus produce a sealing action without additional sealing means. An inner intermediate ring consisting e.g. of metal which must be penetrated by the feed bore hole is used in a favorable shape for reducing the annular space and for stabilizing the flanks.

An alternative to the preceding which likewise enables the use of elastic material and offers substantially the same advantages consists in that the expansion sleeves have a cylindrical jacket having a small wall thickness and annular flanks having a large wall thickness. The accumulation of material in the area of the gaps caused by the flanks also prevents the material under high pressure from flowing away into the gaps toward the spacer sleeves. An inner intermediate ring can a so be provided between the flanks according to this alternative for the purpose of stabilization, the intermediate ring fitting directly on the base body of the probe.

A third modification of the aforementioned expansion sleeves consists in that it comprises a relatively thin-walled flexible cylinder jacket and has a large inner radius of curvature at the outer edge areas with an outer rectangular shape in cross section for the purpose of enlarging the wall thickness, wherein the front sides likewise have a relatively large wall thickness. Also, according to this, the material under high pressure is prevented to a great extent from flowing away into the gaps between the probe and the pipe body, wherein discontinuous stress states are ruled out due to the continuous transitions.

The aforementioned expansion sleeves can be vulcanized on along an area of the probe base body and/or portions of the areas toward the spacer sleeves, depending on their type of deformation work. However, conventional sealing means, particularly O-rings inserted in annular grooves, can also be used for sealing in the aforementioned surfaces.

The aforementioned constructions have the particular advantage that a discharge system can be entirely dispensed with, if necessary, while the annular space located within the expansion sleeves is well sealed due to the fact that pressure medium does not act directly on the pipe body. This makes the construction of the probe considerably cheaper, since the required longitudinal bore holes can only be produced at a high cost and there are technical difficulties involved in the insertion of two parallel bore holes when the probe diameters are small.

The second fundamental construction of the invention which adopts the principle described above, is characterized in that the expansion arrangement comprises symmetrical sealing elements which are arranged in pairs, define the entire expansion area, can preferably be acted upon radially by means of the pressure medium, and enclose an annular space which can be filled with pressure medium, wherein they contact the inner surface of the hollow shaft when the latter is hydraulically expanded and seal the annular space formed in this way relative to the longitudinal portions which remain undeformed.

According to an advantageous construction which allows small and light sealing elements, a spacer piece having a small outer diameter is slid on the base body of the probe between every two sealing elements. According to an alternative, with which the quantity of the sealing places or the open gaps can be reduced, two sealing elements are connected with one another in one piece by means of a shared intermediate ring located within the annular space. The sealing elements and intermediate ring can consist of a sheetmetal strip or a one-piece plastics part, for example.

A first advantageous construction of the sealing elements consists in that the latter are approximately U-shaped in cross section lying in the axial direction with the opening facing the annular space. It can easily be understood that an expansion of the sealing element and a sealing relative to the intermediate portions of the hollow shaft which are not to be expanded can be effected by means of the entrance of pressure medium. According to a special construction, the sealing element can be formed from an L-shaped basic shape with a reinforcing ring provided in the inner angle, instead of the U-shaped cross section. In a first construction, the arrangement can be designed in such a way that the opening of the U-shaped or L-shaped cross section is connected to the annular space so that the pressure medium can be supplied to both sealing elements in this instance via a single feed bore hole to the annular space. An alternative consists in that the opening of the U-shaped or L-shaped cross section communicates with a separate feed bore hole at each sealing element. By means of this, a system of separate feed bore holes for sealing and expansion can be provided in a consecutive sequence with respect to time.

Another possibility for reinforcing the expansion of the sealing elements consists in that the latter comprise an inner bevel in the direction of the annular space in a cross section leading through the axis. According to a first construction, the inner bevel can be partially exposed in the direction of the annular space so that the sealing elements, which are arranged in pairs, can be acted upon by pressure in turn via a central feed bore hole to the annular space. As an alternative to this, the sealing elements can lie in each instance with the inner bevel in the area of their annular groove, so that an application of pressure and a sealing can be effected in this instance via separate feed bore holes before pressure medium overflows into the annular space or is fed to the annular space via another bore hole system.

The shapes of the sealing elements mentioned here are also suitable, according to the invention, for simply constructed probes of the aforementioned type, in which the sealing elements are inserted in annular grooves of a one-piece probe body, wherein the sealing elements are necessarily divided along the circumference in order to be radially flexible. The sealing effect can be maintained regardless of a radial expansion by means of a groove-spring engagement at the butt joint or a splicing diagonally relative to the axis or diagonally relative to the tangential line of the ring.

Another solution is based on a device for the simultaneous hydraulic expansion of a plurality of longitudinal portions of a hollow shaft of the type named in the beginning, in which the probe comprises a one-piece probe body with periodically arranged annular grooves which receives the pressure medium feed channels and, if necessary, the pressure medium discharge channels. A possible first construction is characterized in that expansion arrangements are received by wide grooves, which expansion arrangements communicate with the feed bore holes, wherein an expansion arrangement consists in each instance of a one-piece rubber-elastic expansion sleeve covering the entire expansion area, which expansion sleeve can be acted upon by pressure medium from the inside along substantial portions of its length and is radially expandable in its entirety and is vulcanized on at the probe body in its end areas, wherein its surface contacts the inner surface of the hollow shaft for the hydraulic expansion of the latter. According to this solution, a probe is shown whose basic construction is substantially simplified and in which the sealing elements are less expensive to produce at the cost of a slightly more expensive assembly, since the probe base body can be produced without special fits or threads and a system of discharge bore holes can be dispensed with while maintaining a good sealing action due to the indirect pressure action.

According to a first advantageous construction of such an expansion sleeve, the latter is vulcanized on at the front walls of the annular groove and the adjoining portions of the groove base at the probe base body. As in the expansion sleeves described above, an annular space having a smaller radial thickness can be formed by means of a recess in the expansion sleeve or by means of a recess in the probe base body. An improved connection between the expansion sleeve and the probe base body is to be brought about in that the annular groove is undercut at the end faces in longitudinal section, i.e. is widened e.g. in the manner of a dovetail indent or a pawl.

According to each of the aforementioned variants, the base body of the expansion sleeve can be provided with a reinforcing insert e.g. consisting of a ribbon-like sheet metal spiral or coiled wire or in the manner of a wire framework, so that the expansion is effected in a uniform manner along the length.

Another alternative for a device for the simultaneous hydraulic expansion of a plurality of longitudinal portions of a hollow shaft, in which the probe consists of a probe body with periodically arranged annular grooves, which probe body receives the pressure medium feed and discharge channels, wherein the expansion arrangement comprises symmetrical elements arranged in pairs in each instance, which elements seal the expansion area and are preferably expandable radially by means of the pressure medium, enclose an annular space which can be filled with pressure medium and contact the inner surface of the hollow shaft during the hydraulic expansion of the latter and seal the annular space, consists in that the sealing elements comprise a supporting body, which is externally located with respect to the annular space, and an internal rubber-elastic element, particularly an O-ring. The supporting body can be a metal part or a molded substance which is put in place in situ.

By means of the adaptation to the shape of the rubber-elastic sealing element, the latter is prevented from flowing into the gaps under high pressure toward the intermediate portion which is not to be expanded. In addition to this, another possibility consists in that the sealing elements comprise an elastic expansion body which is located axially on the inside with respect to the annular space and has a greater strength than the rubber-elastic elements It is possible to construct the outer sealing and supporting element and the inner expansion element in one piece or to produce them from two rings whose joints are offset relative to one another, the rubber-elastic element being held between the rings.

An alternative to the aforementioned solutions which likewise prevents the rubber-elastic body from flowing into the gap under high pressure consists in that the sealing elements comprise a rubber-elastic element in each instance, particularly an O-ring with a cast in annular hose spring, wherein this can be displaced eccentrically in the direction of the gap. Also, this prevents the elastic substance under high pressure from flowing away.

Another possibility of sealing elements arranged in pairs consists of annular sleeves of flexible material, e.g. leather, Kevlar or fiber-reinforced work materials, which open toward one another in a C-shaped manner, a spreading and flow body being inserted between the sleeves, which spreading and flow body prevents the sleeves from collapsing and ensures that the interior spaces of the annular sleeves are acted upon by pressure medium from out of an inner feed bore hole. The outer areas of the sleeves contact the pipe to be expanded accompanied by the application of pressure and thus form the required annular space which can be acted upon by pressure. The sleeves can be secured by their inner area with clamping rings, each of which is in a groove. The spreading body can be constructed as a solid ring or as an axially pretensioned annular cage.

Additional details of the invention shown above in their various possibilities are provided in the following descriptions of the drawings.

FIG. 1 shows a built-up probe with expansion sleeves and spacer bushes slid thereon.

Figure 2A:
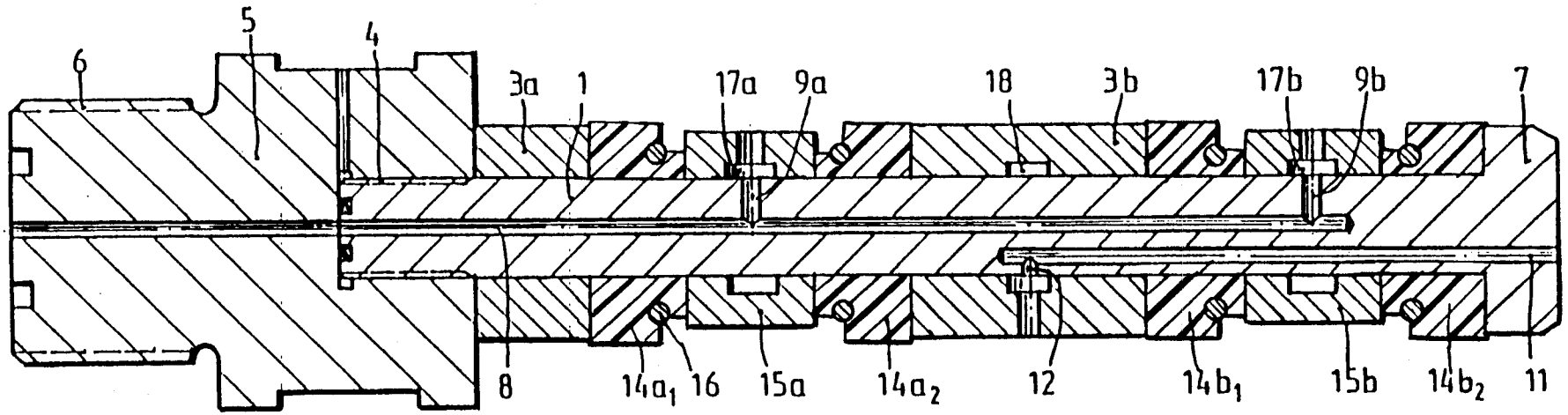

FIG. 2*a* shows a built-up probe with sealing elements, intermediate sleeves and spacer bushes slid thereon.

Figure 2B:
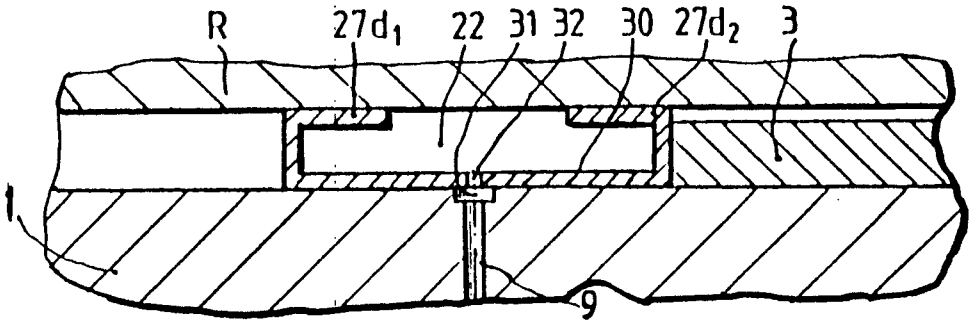

FIG. 2*b* shows an exploded view of a widened annular space on the probe body.

Figure 3A:
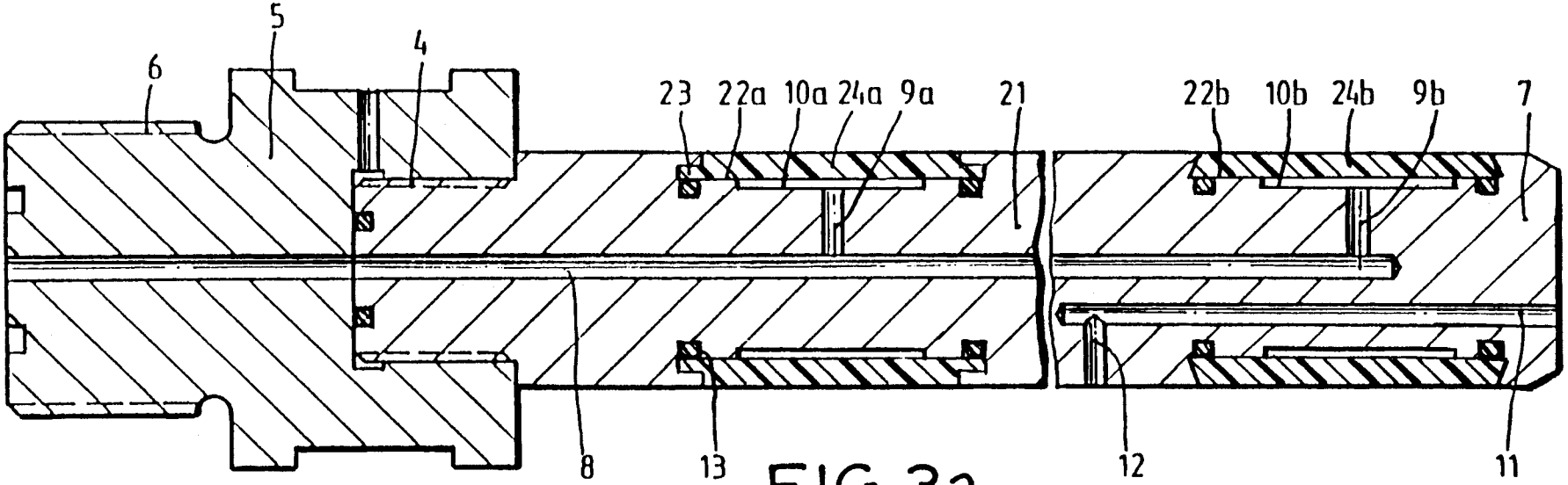

FIG. 3*a* shows a device with a one-piece probe base body with annular grooves with expansion sleeves which are vulcanized on.

Figure 3B:
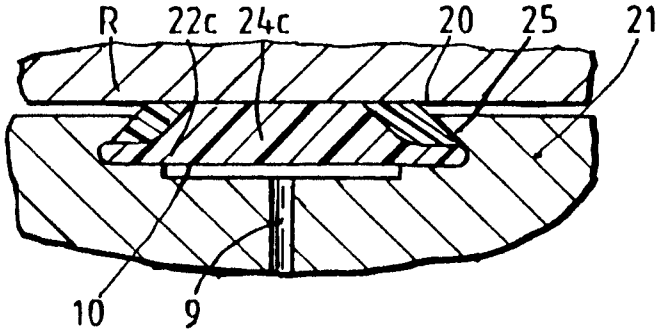

FIG. 3*b* shows another construction of the dove tail like shape of the groove.

Figure 4:
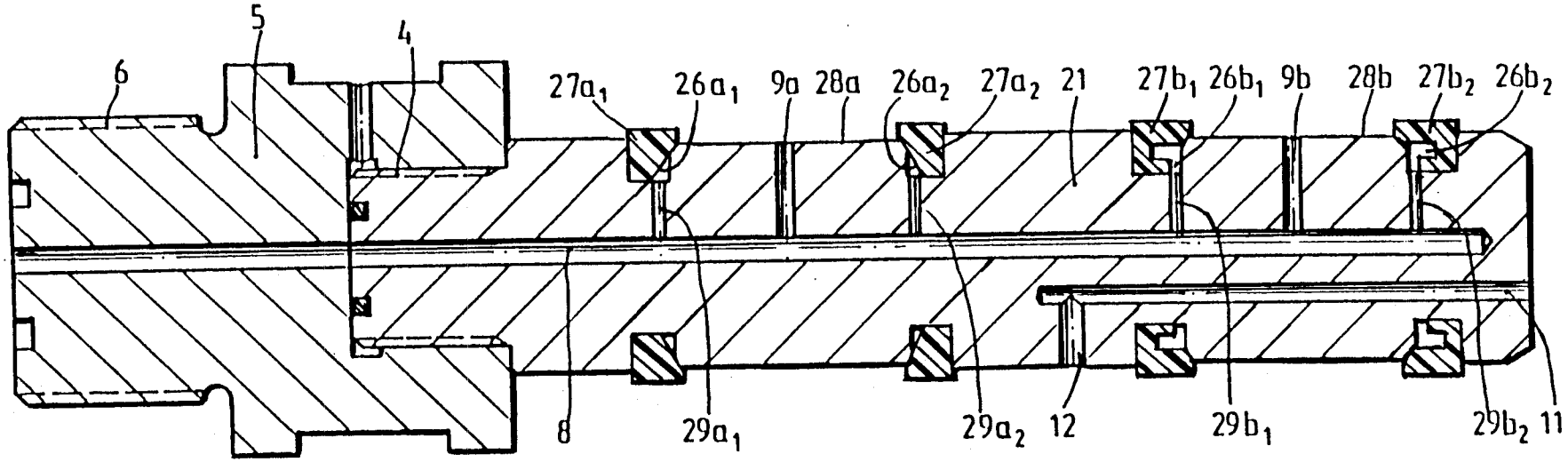
Figure 5A:
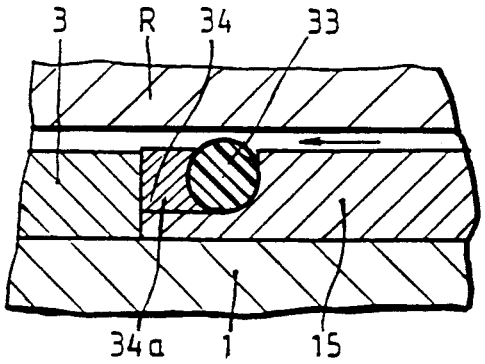
Figure 5B:
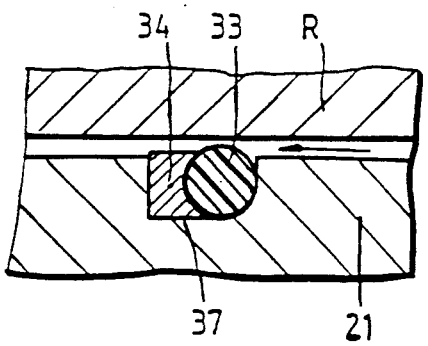
Figure 6A:
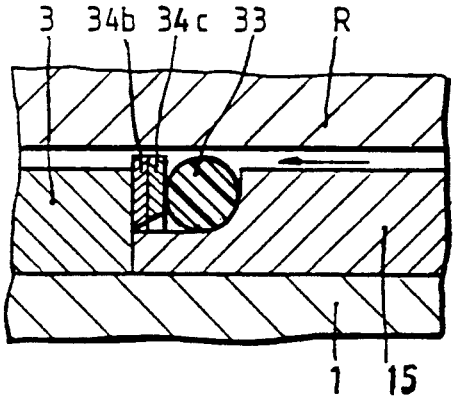
Figure 6B:
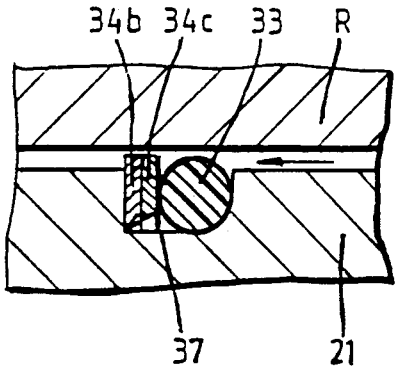
Figure 7A:
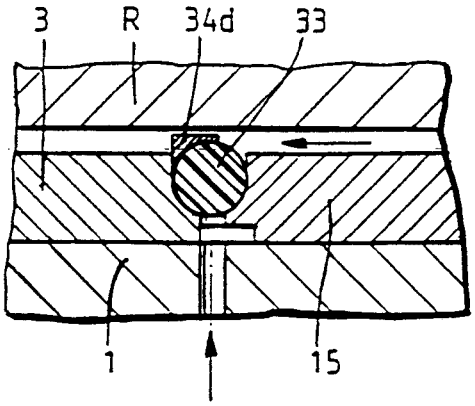
Figure 7B:
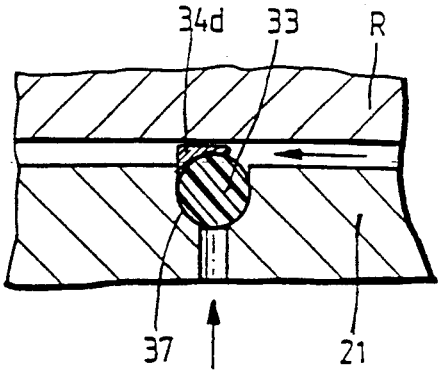
Figure 8A:
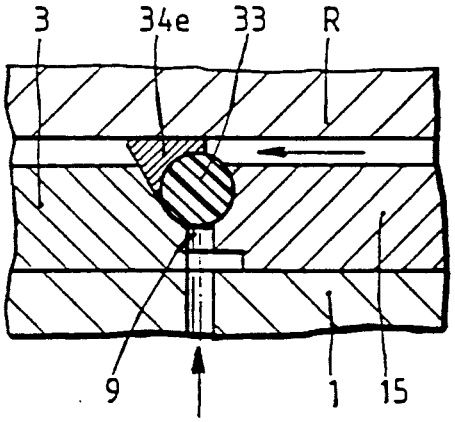
Figure 8B:
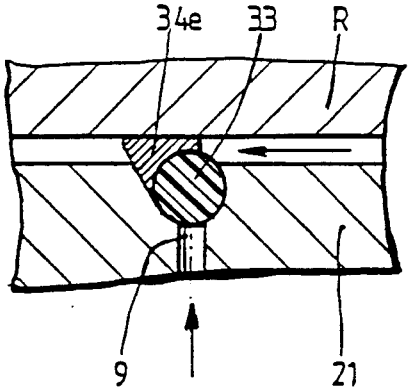

FIG. 4 shows a device with one-piece probe base body comprising annular grooves with sealing elements constructed in pairs.

FIGS. 5*a* and 5*b* to 8*a* and 8*b* show sealing elements, according to the invention, with external supporting bodies in versions for built-up probes (a) and one-piece probes (b).

Figure 9:
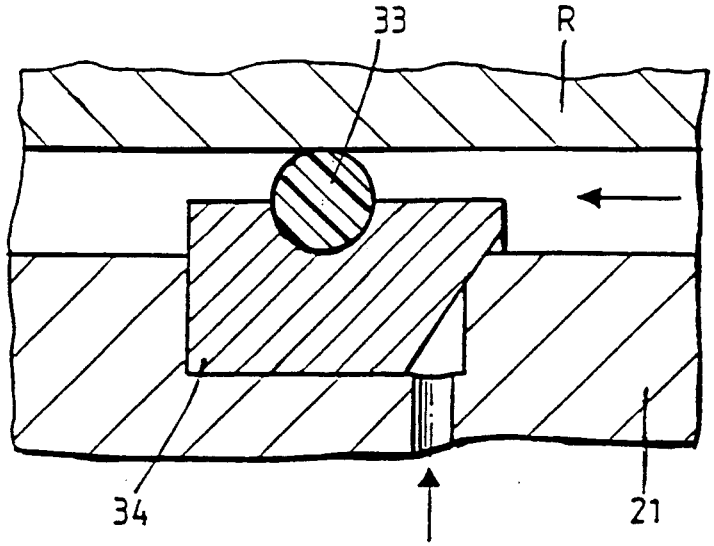
Figure 10:
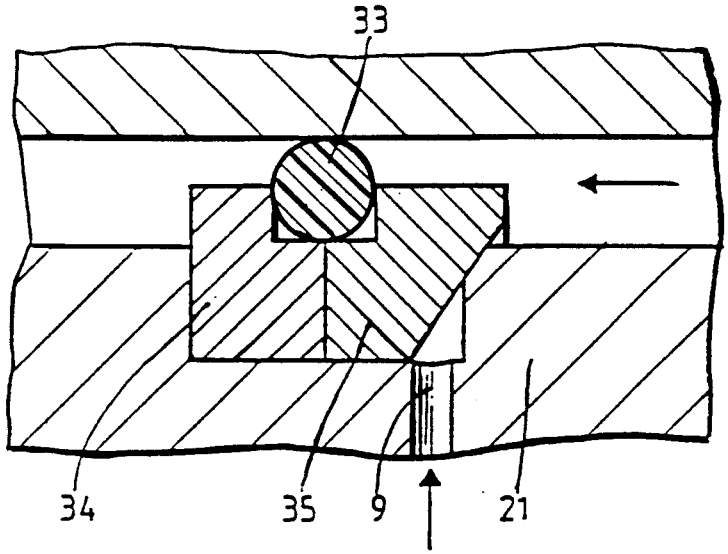
Figure 11:
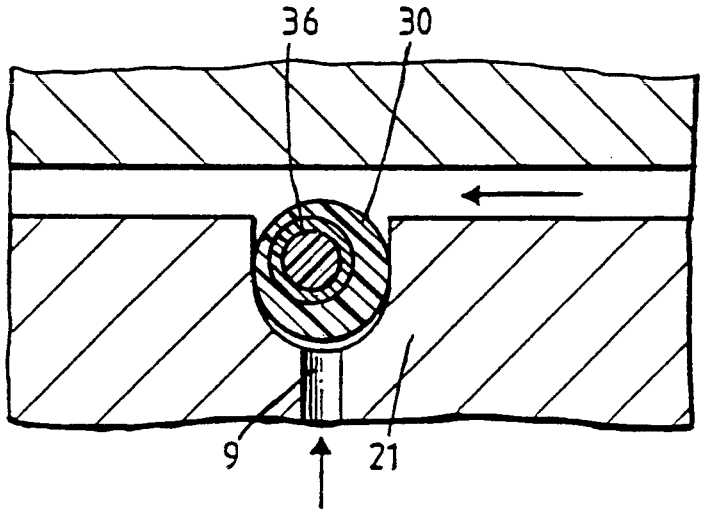
Figure 12A:
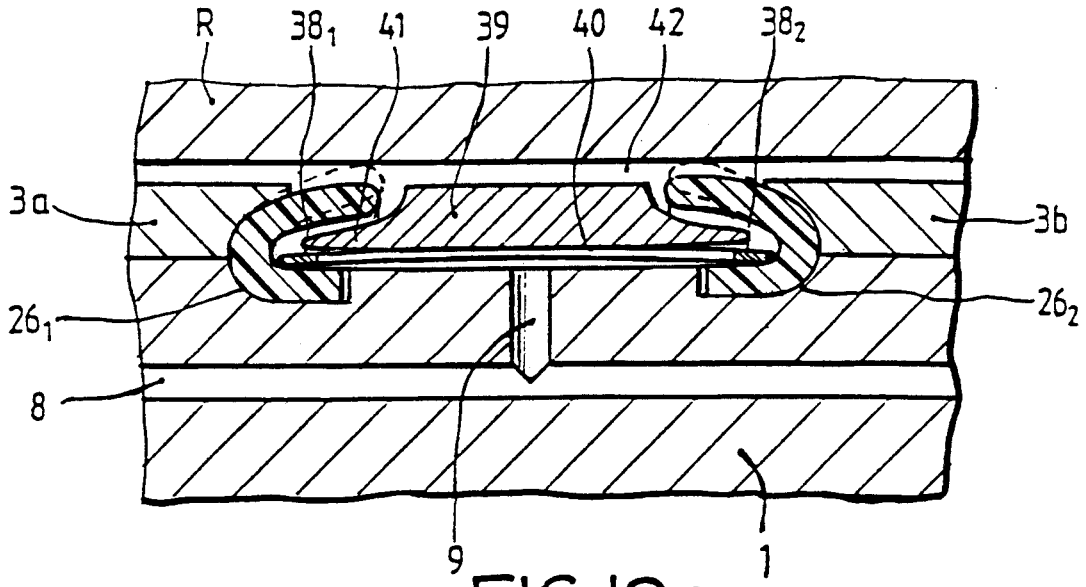
Figure 12B:
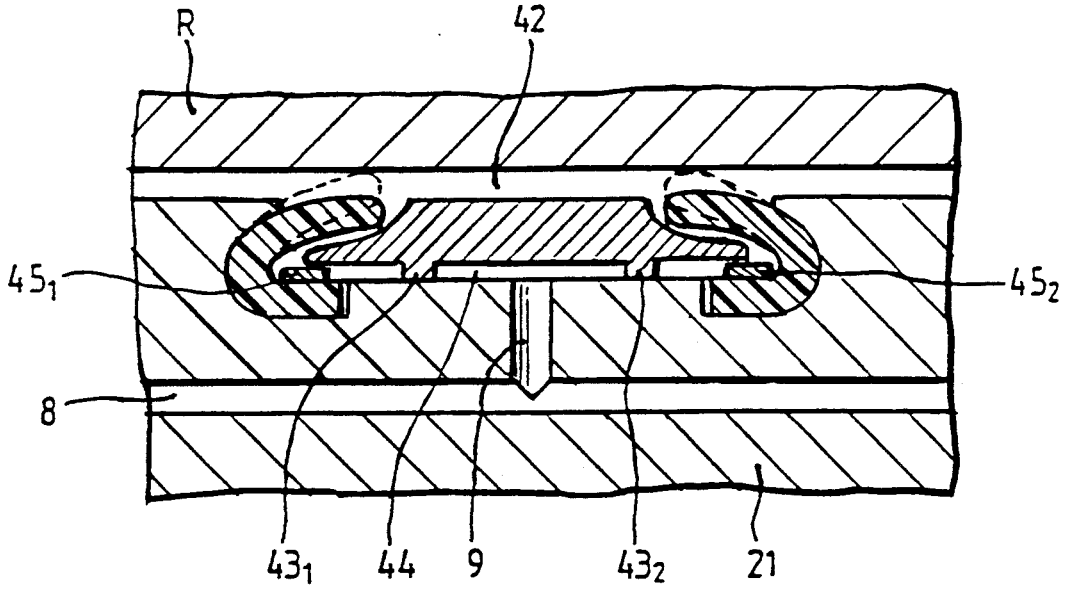

FIGS. 9 to 11 show sealing elements, according to the invention, for probes preferably designed in one piece. FIGS. 12*a* and 12*b* shows sealing elements, according to the invention, of a flexible type for built-up probes (a) and one-piece probes (b).

Figure 13A:
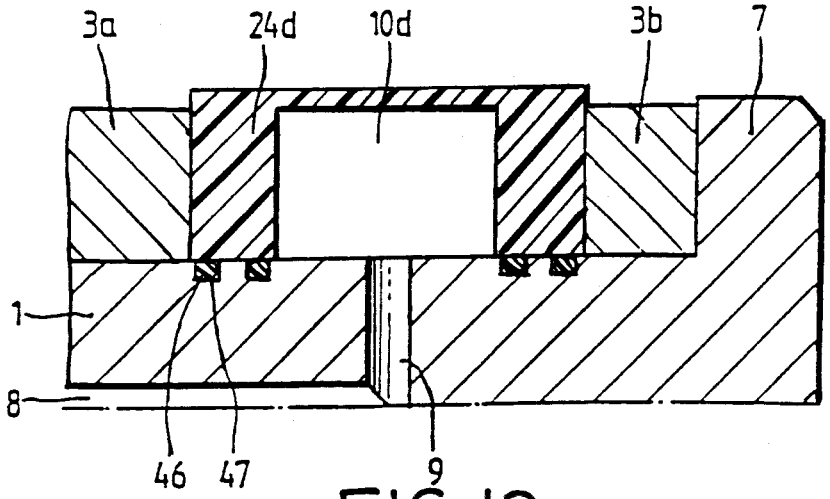
Figure 13B:
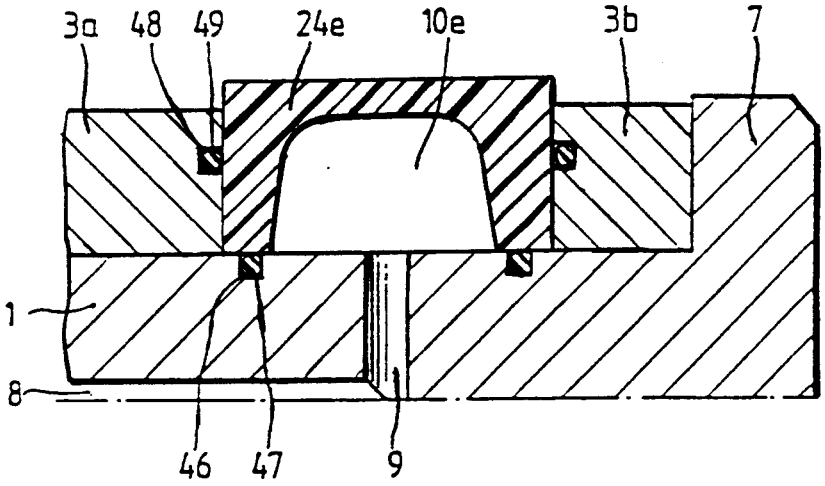
Figure 13C:
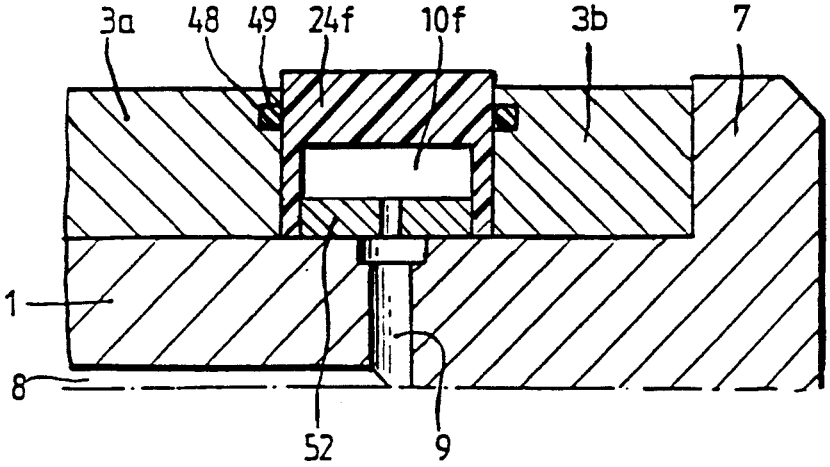

FIGS. 13*a* to *c* shows sealing elements, according to the invention, preferably for built-up probes.

In FIGS. 1 to 4 corresponding parts are designated by the same reference numbers.

FIG. 1 shows a probe, according to the invention, having a probe base body 1 of substantially uniform diameter and radially expandable expansion sleeves 2 and spacer pieces 3 slid thereon in two different embodiments. A thread 4, on which a connection piece 5 is screwed, which in turn comprises an external thread 6 for connecting with a pressure line of a pressure generating device, is provided at one end of the base body. The base body 1 comprises a thickened probe head 7 at its other end, which probe head 7 forms an axial stop for the expansion sleeve 2*b*. The connection piece 5 and the base body 1 are penetrated by a central feed channel 8 from which proceed radial feed bore holes 9 which open into recessed annular spaces 10 below the expansion sleeves 2. The probe comprises a discharge channel 11 in an eccentric manner, radial discharge bore holes 12, which open out below the spacer pieces 3, proceed from the radial discharge bore holes 12. The expansion sleeves 2 are sealed relative to the spacer sleeves 3 by means of O-rings 13 which are inserted in annular grooves, wherein the expansion sleeve 2*a* engages under the respective adjoining spacer sleeves with a shoulder, while the spacer sleeve 2*b* comprises a radial end face, by which it is supported at the probe head 7 and the adjoining spacer sleeve 3*b*.

FIG. 2*a* shows a device of substantially the same construction as that in FIG. 1, wherein, in contrast to the latter, sealing elements 14, which are arranged in pairs between the spacer sleeves 3 and comprise spacer rings 15 lying between them, are slid on the probe base body 1. The sealing elements 14 have approximately L-shaped cross sections, wherein an annular insert 16 serves for reinforcement. The outer diameter of the sealing elements projects beyond the spacer sleeves 3. The intermediate sleeves 15 comprise an inner annular space 17 which communicates with the feed bore hole 9 regardless of the position, wherein this feed bore hole 9 continues through the intermediate sleeve 15 and forms the connection to an annular space enclosed between the sealing elements 14. The intermediate sleeve 15 has a smaller diameter than the sealing elements 14. The spacer bush 3*b* likewise has an inner annular space 18 which forms the connection to a discharge bore hole 12 regardless of the position, the discharge bore hole 12 continuing in the bush. The guiding back of the leakage water is effected for this bore hole and the discharge channel 11, the leakage water exiting from the expansion areas, which are predetermined by means of the two seal pairs, and arriving in the undeformed portion determined by means of the spacer sleeve. The spacer sleeve 3*a* which is supported directly at the end face of the connection piece 5 does not require such a guiding back, since it is already located partially outside the hollow shaft which is to be deformed. The spacer sleeves, sealing elements and intermediate sleeves are held and lightly clamped, respectively, by the thickened head 7 of the probe body 1.

FIG. 2*b* shows a widened annular space 22 on the probe base body 1 as a detail, which annular space 22 is formed by means of two sealing elements 27*d* which are connected with one another via a shared middle portion 30 and open inwardly in a U-shaped manner. The double sealing body formed in this way is preferably welded annularly with the base body 1 in the area of its middle portion 30, wherein an annular groove 31 below the sealing body and a bore hole 32 in the middle portion 30 form the connection from the feed bore hole 9 to the annular space 22 seen here between the seals and the pipe body R. The continuous double sealing body can easily be slid over a probe base body 1 of uniform cross section and fastened on the latter so as to result in a substantially simplified manner of construction. An axial support by means of a spacer sleeve 3 is possible—as shown at right—but with indirect fastening on the base body—shown at left—is not required.

In FIG. 3*a*, a probe is shown with a one-piece probe base body 21 which is connected with the connection piece 5 in the same manner as in FIGS. 1 and 2 and comprises feed channels and feed bore holes as well as discharge channels and discharge bore holes of the same type as the constructions shown above. In addition, the probe base body comprises two annular grooves 22 having different cross sections which are inserted directly into the probe body. The annular groove 22*a* has grooves 23 at its flanks in which an expansion sleeve 24 engages in the manner of a pawl. Below the expansion sleeve 24, an annular space of small radial thickness is recessed into the probe base body and communicates with a feed bore hole 9 which proceeds from the central feed channel 8. The expansion sleeve 24 preferably consists of inelastic work material and is vulcanized on in the area of the recessed lateral flanks of the annular groove 22*a* and its base area toward the annular space 10. The same applies substantially for the annular groove 22*b* having a cross section of trapezoidal shape in which the expansion sleeve 24 is inserted.

FIG. 3*b* shows another construction as a detail, in which construction the dovetail-like cross-sectional shape of the groove 22*c* is more sharply pronounced, wherein the flanks have pronounced tips 25. Reinforcements 26 consisting of plastic substance or plastics material are inserted in the area of these tips and prevent the rubber-elastic sleeve 24*c* under high pressure from flowing away into the gaps between the hollow body R and the probe base body 21 indicated here.

In conformity with FIG. 3, FIG. 4 shows a one-piece probe base body 21 in which grooves 26*a*, 26*b* having a substantially rectangular cross section and arranged in pairs are inserted. Sealing elements 27*a*, 27*b*, which are symmetrical in pairs and proceed outward along the diameter of the probe base body, are inserted into the grooves. A probe area 28 of small diameter lies between the grooves in each instance and, with the hollow shaft to be expanded and the seals, forms an annular space to which pressure medium can be fed via the feed bore hole 9 and the feed channel 8. In addition to the feed bore hole 9, additional feed bore holes 29 to the annular grooves are provided which can join or replace the bore hole 9. The seal rings 27*a* comprise an inner bevel which causes the seal to be pressed outward within the groove and generates a radial force component for the expansion. In this process, pressure medium can overflow from the groove into the annular space between the seals, since the bevel extends beyond the diameter of the portion 28 already in the relaxed state. In the reverse manner, pressure medium can also reach the annular grooves from the annular space via the feed bore hole 9, which pressure medium then likewise expands the seals radially.

The seals 27*b* are constructed so as to be open toward one another in an approximately U-shaped manner in cross section, so that a feed of pressure medium via the feed bore hole 9 or via the feed bore hole 29*b* to the individual annular grooves 26*b* enables an expansion of the U-shaped seal body and in this way also enables a sealing relative to the hollow shaft body, not shown. Also, the shape is combined with an internal bevel at the outer leg, so that pressure medium can also reach the grooves from the annular space or can reach the annular space from the grooves in this instance as well, so that one of the lines 9 or 29 can be omitted as desired. However, to the extent that the lines 9 and 29 are fed via different feed channels, the volume of leakage medium can be reduced in that the seals are first acted upon and the annular space is only then filled with pressure medium.

FIGS. 5 to 11 show an annular, rubber-elastic sealing element of the O-ring type, designated in each instance by 33, and a supporting element 34, designated by 34, which is externally located with respect to the application of pressure medium indicated by the arrow. In addition, FIG. 10 shows an internal supporting element 35, while an internal supporting element 36 of the hose spring type is inserted in the sealing element 33 in FIG. 11. In addition, a probe base body of uniform cross section is designated by 1, intermediate sleeves by 15 and spacer sleeves by 3, respectively, while a probe base body of uniform cross section with recessed grooves 37 of various cross-sectional shapes is designated by 21. R indicates the pipe located on the outside or the hollow shaft to be expanded, respectively. Inner feed channels are designated by 9.

In FIG. 12, according to a first embodiment example according to a), a pair of flexible sealing elements 38, consisting e.g. of leather or Kevlar or carbon fiber reinforced graphite material, is inserted in annular grooves 26 and guided by a supporting body 39 and external spacer bushes 3*a*, 3*b*. The sealing elements lie in a flange-like manner around annular projections 41 of the supporting body. A springing annular body which is curved in cross section and acts as a spring element and presses the supporting body with the sealing elements outward against the pipe is provided below the supporting body 39. The outer areas of the annular body simultaneously hold the inner ends of the sealing elements. The pressure medium is pressed under the supporting body and between the sealing elements via a central feed channel 8 and a feed bore hole 9, the sealing elements thereby abutting at the pipe with their outer areas and forming a closed inner annular space 42. In the embodiment example according to b), a one-piece probe body 21 is shown in contrast to the preceding, in which one-piece probe body 21 a widened groove 23 receives the sealing elements 38 and the supporting body 39; instead of the spring ring, the supporting body comprises two spreaders 43 which define an inner annular space 44 from which the pressure medium can flow into the annular space 42 within the sealing elements 38. The inner portion of the sealing elements is held in its position in each instance by means of separate inner clamping rings 45. The application of pressure is also effected in this instance via a feed channel 8 and a radial feed bore hole 9.

A probe constructed from a probe base body 1 and spacer elements 3 is designated by a in FIG. 13, a one-piece expansion element 24*d*, which consists of rubber-elastic material of great Shore hardness and encloses an inner annular space 10*d*, being inserted in the probe between two spacer sleeves. The annular space is acted upon by pressure medium via an axial feed channel 8 and a radial feed bore hole 9. The annular end faces of the expansion element 24*d* have a greater wall thickness compared with the outer circumference, so that only the latter is flexible and causes the expansion of the outer pipe, while a greater accumulation of material in the area of the outer corners prevents the material from flowing away into the edge areas. Within the expansion element, annular grooves 46 with sealing elements 47 are provided in the probe body 1.

The embodiment example according to b shows a fundamentally similar construction of a probe base body 1 with spacer pieces 3 slid thereon, the latter abutting at the probe head 7, wherein the expansion element 24*e* has approximately the same material thickness at the flanks on the front side and at the outer circumference, while only the outer edge areas have a continuously constructed material reinforcement. In addition to the annular grooves 46 with sealing rings 47, additional annular grooves 48 with additional sealing elements 49 are provided in the flanks of the spacer sleeves. The feed of pressure medium is also effected in this instance via a central feed channel 8 and radial feed bore holes 9.

In the construction according to c, a probe base body 1 is constructed with spacer sleeves 3 which are slid thereon and which abut at the probe head 7, expansion elements 24*f* having thin-walled flanks in comparison to the outer jacket being provided between these spacer sleeves 3. An annular supporting body 52 is provided within the flanks which reduces the internal space 10*f* in volume and clamps and stabilizes the flanks. The outer jacket should accordingly be uniformly expandable under the influence of the pressure medium. Sealing elements 49 are provided in annular grooves 48 at the flanks. Other shapes of the seal are conceivable, in which the supporting body 52 engages in grooves in the flanks of the expansion element and engages the latter with projections in grooves in the spacer pieces.

The aforementioned embodiment examples have the advantage that a system of discharge bore holes and channels are not required because of the sealed annular space 10.

List of Reference Numbers

| | |
|---|---|
| 1 | probe base body |
| 2 | expansion sleeve |
| 3 | spacer piece |
| 4 | thread |
| 5 | connection piece |
| 6 | external thread |
| 7 | probe head |
| 8 | feed channel |
| 9 | feed bore holes |
| 10 | annular space |
| 11 | discharge channel |
| 12 | discharge bore hole |
| 13 | O-ring |
| 14 | sealing element |
| 15 | spacer ring |
| 16 | ring insert |
| 17 | annular space |
| 18 | annular space |
| 19 | — |
| 20 | — |
| 21 | probe base body |
| 22 | annular groove |
| 23 | groove (in 21) |
| 24 | expansion sleeve |
| 25 | tips (flanks) |
| 26 | annular groove |
| 27 | sealing ring |
| 28 | annular space |
| 29 | feed bore holes |
| 30 | middle portion |
| 31 | annular groove |
| 32 | bore hole |
| 33 | O-ring |
| 34 | supporting body (outer) |
| 35 | supporting body (inner) |
| 36 | sealing element |
| 39 | supporting body |
| 40 | spring ring |
| 41 | annular projection |
| 42 | annular space |
| 43 | spreader |
| 44 | annular space |
| 45 | clamping ring |

-continued

| | |
|---|---|
| 46 | annular groove |
| 47 | sealing element |
| 48 | annular groove |
| 49 | sealing element |
| 50 | — |
| 51 | — |
| 52 | supporting body |

We claim:

1. Device for the simultaneous hydraulic expansion of a plurality of longitudinal portions of a hollow shaft for the production of at least one of force-locking and positive-locking connections between the hollow shaft portions and elements slid thereon, such as cams, toothed wheels or bearing seats, in the form of a pressure medium probe comprising at least one longitudinally extending feed channel and radial feed bore holes to each of the longitudinal portions of the hollow shaft to be expanded and comprising sealing means which seal longitudinal portions of the hollow shaft which remain un-deformed against the action of the pressure medium from longitudinal portions of the hollow shaft to be expanded which lie between them, characterized in that the probe comprises a probe base body (1) of substantially uniform diameter, which contains the feed channels (8) and feed bore holes (9), and expansion arrangements (2, 24) which are slid thereon and communicate with the feed bore holes (9), the expansion arrangement comprising a one-piece expansion sleeve (2, 24) and spacer pieces (3) arranged between the expansion arrangements (2, 24), the expansion sleeves being sealed at their respective ends directly against at least one of the spacer pieces and the probe base body, said probe base body (1) having a longitudinally extending relief channel (11) and radial discharge bore holes (12) which open out below the spacer pieces (3).

2. Device according to claim 1, wherein the expansion arrangement includes a one-piece expansion sleeve which covers an entire area to be expanded with an essentially constant diameter, the expansion sleeve being acted upon internally by a pressure medium along the substantial portions of the sleeve length, and the expansion sleeve being radially expandable in its entirety so that the expansion sleeve surface contacts the inner surface of the hollow shaft so as to hydraulically expand the hollow shaft.

3. Device according to claim 2, and further comprising seals (49) received in annular grooves (48), and are provided in radial flanks of the spacer sleeves (3*b*) adjacent to the expansion sleeves (2*b*).

4. Device according to claim 1, wherein the expansion arrangement comprises respectively symmetrical sealing elements (14, 33) which bound the entire expansion region and are arranged in pairs so as to enclose an annular space fillable with pressure agent, and which come to rest at the inside surface of the hollow shaft and seal the annular space during hydraulic expansion of the hollow shaft.

5. An arrangement according to claim 2, characterized in that the expansion sleeves (2*a*) are sealed by means of labyrinth seals on their end side against the respective adjoining spacer pieces (2*b*).

6. A device according to claim 2, characterized in that the expansion sleeves (2*a*) grip beneath the respectively adjoining spacer pieces (2*b*) in one of a pawl-like and a dove-tailed manner.

7. Device according to claim 2, characterized in that the expansion sleeves (2, 24) are sealed at their outer edge areas relative to the probe base body (1) particularly by means of O-rings (13) lying in grooves.

8. Device according to claim 2, characterized in that the expansion sleeves (2, 24) are sealed relative to the abutting spacer pieces (3).

9. Device according to claim 1, characterized in that the expansion sleeves (2, 24) cover an annular space (10) which is recessed into the probe base body (1).

10. Device according to claims 1, characterized in that the expansion sleeves (2, 24) comprise an inner recessed or formed out annular space (10).

11. Device according to claims 1, characterized in that the expansion sleeves (2, 24) comprise an inherently rigid plastics material.

12. Device according to claim 10, characterized in that the expansion sleeves (24*d*) comprise a cylindrical jacket of small wall thickness and annular flanks of large wall thickness.

13. Device according to claim 10, characterized in that the expansion sleeves (24*e*) comprises a continuously increasing wall thickness in the direction of the outer annular edges.

14. Device according to claim 10, characterized in that the expansion sleeves (24*f*) have a cylindrical jacket having a large wall thickness and annular flanks of small wall thickness which are supported externally by the spacer pieces (53).

15. Device according to claim 10, characterized in that a fixed spacer ring (52), which is slid on the probe base body (1, 51) and forms an annular space (10) with the cylindrical jacket, is inserted between the annular flanks of the expansion sleeves (24).

16. Device according to claim 10, characterized in that the expansion sleeves (24) comprise rubber-elastic material of high Shore hardness.

17. Device according to claim 15, characterized in that the spacer ring (52) is cemented, in particular vulcanized on, with the annular flanks of the expansion sleeves (24).

18. Device according to claim 2, characterized in that the sealing elements (14) are approximately U-shaped in cross section with an opening facing toward the annular space.

19. Device according to claim 2, characterized in that the sealing elements (14) are approximately L-shaped in cross section with legs which lie axially outward and radially inward with respect to the annular space.

20. Device according to one of claim 2, characterized in that a connection from an opening (26), which lies within the sealing elements (14) in cross section, to the annular space is provided for the passage of pressure medium.

21. Device according to one of claim 2, characterized in that a connection from a feed bore hole (29) to an opening (26) lying within the sealing elements (14) in cross section is provided for the passage of pressure medium.

22. Device according to one of claim 2, characterized in that the sealing elements (14) in cross section comprise an inner bevel in the direction of the annular space.

23. Device according to claim 22, characterized in that the inner bevel is partially exposed toward the annular space for the purpose of application by pressure medium.

24. Device according to claim 22, characterized in that the inner bevel is exposed to a feed bore hole (29) for application by pressure medium.

25. Device according to claim 2, characterized in that two sealing elements (27*d*) which are assigned in pairs are connected with one another via an internal middle web (30) and the latter is fastened directly on the probe base body (1) and embraces a portion of the feed bore hold.

26. Device according to claim 25, characterized in that the sealing elements (27*d*) with the middle web (30) comprise a flanged sheet-metal ring.

* * * * *